US006131965A

United States Patent [19]

Trammell, Jr.

[11] Patent Number: 6,131,965

[45] Date of Patent: Oct. 17, 2000

[54] CHILD-KEY-GUARD UNIT

[76] Inventor: Earl M. Trammell, Jr., 2224 Village Green Pkwy., Apt. 8, Chesterfield, Mo. 63017

[21] Appl. No.: 09/289,869

[22] Filed: Apr. 12, 1999

Related U.S. Application Data

[63] Continuation-in-part of application No. 08/786,746, Jan. 24, 1997, Pat. No. 5,927,775, which is a continuation-in-part of application No. 08/534,642, Sep. 27, 1995, Pat. No. 5,676,409.

[51] Int. Cl.[7] ..... E05C 19/00

[52] U.S. Cl. ..... 292/1; 292/DIG. 2; 292/346; 292/336.3

[58] Field of Search ..... 70/38, 207, 158, 70/181, 379 R, 417, DIG. 58; 292/1, 336.3, 346, DIG. 2

[56] References Cited

U.S. PATENT DOCUMENTS

| | | | |
|---|---|---|---|
| 2,629,246 | 2/1953 | Schumann | 70/181 |
| 2,660,874 | 12/1953 | Ziomek | 70/181 |
| 2,708,845 | 5/1955 | Trammell | 70/181 |
| 2,735,289 | 2/1956 | Trammell | 70/181 |
| 3,206,956 | 9/1965 | Trammell | 70/181 |
| 3,408,836 | 11/1968 | Trammell | 70/181 |
| 3,875,773 | 4/1975 | Thimot | 70/337 |
| 3,999,788 | 12/1976 | Livingston | 292/1 |
| 4,084,414 | 4/1978 | Martin | 70/181 |
| 5,574,315 | 11/1996 | Weber | 307/10.1 |

*Primary Examiner*—Neill Wilson
*Assistant Examiner*—Gary Estremsky
*Attorney, Agent, or Firm*—Senniger, Powers, Leavitt & Roedel

[57] ABSTRACT

A door locking system for child-safety door locking systems on an automobile door including a latch and a door lock mechanism. The door handle is incapable of unlatching the door when the locking mechanism locks the latch. The locking system includes a door panel having an opening for receiving a lock button mounted on a lock rod connected to the locking mechanism and movable between locked and unlocked positions. A shield is movable within the opening relative to the lock button and door panel between a retracted inoperative position corresponding to a normal lock mode in which the shield is recessed in the opening for accessing the lock button for moving the lock button between its locked and unlocked positions, and an extended operative position corresponding to a guard lock mode in which the shield extends outward of the opening to shield the lock button in its locked position to prevent access to the lock button for manual movement to its unlocked position. A key lock is operatively connected to the shield for selectively moving the shield between its inoperative and operative positions.

15 Claims, 12 Drawing Sheets

813
817
875
814
891
896
895
894
881
872
883
889
874
107

813
107
875
814
896
895
894
881
872
883
889
874
878
891
815
817

813
875
817
896
895
894
814
891
107
878
874
889
883
872
881

813
875
817
814
896
894
895
815
891
107
878
874
889
883
872
881

CHILD-KEY-GUARD UNIT

CROSS REFERENCE TO RELATED APPLICATION

This application is a continuation-in-part of my U.S. patent application Ser. No. 08/786,746, filed Jan. 24, 1997, now U.S. Pat. No. 5,927,775 which is a continuation-in-part of my U.S. patent application Ser. No. 08/534,642, filed Sep. 27, 1995 now U.S. Pat. No. 5,676,409.

BACKGROUND OF THE INVENTION

This invention relates generally to door locking systems, and more particularly to standard equipment child-safety door locking systems for automobile doors.

There are presently systems which prevent the rear doors of automobiles from being unlocked and opened by children while the automobile is in motion. At present, all major car makers are incorporating as standard equipment a child-safety locking system of European origin that consists of adding a separate mechanical unit to the rear doors in addition to the regular locking unit. This child safety locking unit has a small lever that is positioned on the face of the door panel which requires that the door be opened to access the lever. The child safety locking unit requires manual setting for (1) normal locking and (2) child-safety locking. Normal locking permits the door to be locked, unlocked and opened by manipulation of the regular locking unit and door latch from inside the vehicle. However, when child safety locking is activated the door becomes totally inoperable from the inside whether the regular locking unit is locked or unlocked. The door may then be opened only from the outside, and then only when the regular locking unit is unlocked.

This means that when child safety locking is activated, the driver always has the inconvenience of having to exit the car in order to let the children in the rear out. There is this same aggravation when adults are in the rear and the driver forgets to position the lever to return the door to normal locking. Also, the driver has no visual reference as to whether the rear doors are in a child safety or normal locking mode. The driver must make sure the locking unit of the rear door is unlocked, and either: (1) strain to reach back and check the rear door handles; or (2) exit the car and open the rear door from the outside. Moreover in certain circumstances, such as in an accident where the car rolls upside down, the driver may not be able to unlock or to open the rear door from outside the automobile. The child safety power door locking system of the present invention completely eliminates the above problems and inconveniences as well as providing for other substantial advantages over the present system.

I patented Child-Guard® rear door lock actuator shields in the 1950's (e.g., U.S. Pat. Nos. 2,955,858, 2,694,917, 2,708,845, 2,735,289 and 2,939,307). Power locks were not available at this time. My lock actuator shields were designed and made by my company, E-M-T Enterprises, for General Motors, Ford, Chrysler and American Motors cars, and were sold in volume from 1956 until 1987. Production ceased only in 1991 at which time all automobile manufacturers had incorporated the European child-safety locking system as standard equipment. My Child-Guard® lock actuator shields were confined accessory products, sold only to the major car companies.

Generally speaking, my prior actuator shields have an opening for receiving the manual look actuator in closely spaced relation with the shield. There is too little space between the shield and the lock actuator in the opening to grasp the lock actuator, or even to insert a thin instrument such as a key to pry the lock actuator back to an unlocked position. However, these shields have a slot (i.e., a second opening) in them which is too small for a child's fingers to reach the lock actuator, but which would permit insertion of the car key through the shield to unlock the door. Power door locking was not available on automobiles until the early 1970's. However, sales of my accessory lock shields continued to be strong until the late 1980's when nearly all automobiles began to incorporate the European child safety locking system described previously.

My original child safety manual lock actuator shields were an accessory product that where installed around the standard equipment manual lock actuator and used a car key for unlocking.

SUMMARY OF THE INVENTION

The invention presented herein and in the previously filed co-pending applications Ser. Nos. 08/786,746 and 08/534,642, which are incorporated herein by reference, introduces to the automobile maker a new standard equipment child-safety locking system that operates in direct combination with power door locking systems on all makes of new cars. My new child safety door key locking system is standard equipment. It does not use a slotted shield and cannot be manipulated with a car key. Rather, the sole means for unlocking the door when the locking system is operating in a guard lock mode is by either a key adapted for use with a key lock installed as part of the locking system, or by the power door locking unit if the automobile has a power locking system. My new locking system incorporates the integral action of: (1) normal locking; (2) hand guard shielding; and (3) key locking or power door locking, not previously found in child-safety door locking systems.

This new child-safety locking system, which operates in both a guard lock mode and a normal lock or conventional mode in which the door locks can be manually opened at any time, provides for definite improvements over the European child safety locking system that is now being used as standard equipment by all the major car manufacturers. Specifically, this new system will be mechanically simpler, cost less and also be more dependable and convenient to operate. There is no separate mechanism which must be added to the standard door locking mechanism or the power locking mechanism, thereby eliminating the need and cost for an additional unit and reducing the possibility of malfunction. Additionally, it will provide the driver with quick, positive and convenient control over child-safety locking and unlocking that was not previously available.

In particular, the invention presented herein relates to the first and second embodiments of the previous applications and is disclosed in the figures of the drawings added thereto and that part of the specification relating to the added figures. Common to these embodiments is that the manual lock actuator is a lock button type actuator mounted on a lock rod. In both embodiments, the lock button is moved relative to the lock rod to allow switching between the normal lock mode and the guard lock mode. In the second embodiment, the lock button must be completely removed from the lock rod and the original equipment lock button mounted back on the lock rod to switch from the guard lock mode to the normal lock mode.

The embodiment of the present invention provides a key lock and lock housing for mounting a movable shield within the door panel around the lock button and lock rod. This makes for a very clean original equipment installation because the key lock and lock housing are mounted on the door panel so that the key lock face and slot are the only elements visible on the face of the inside door panel. Rotation of the key lock, via a key, provides for positive positioning of the shield with respect to the lock button for either the normal lock mode or the guard lock mode. While in this embodiment the key is used to change lock modes of the locking system, the power locking system still allows the driver to quickly open the rear doors via the power door button. However, where a power locking system is unavailable or inoperable, the key lock and easy to use key (which can be kept on a key ring) provide the driver with a quick, alternative means for repositioning the shield to the normal lock mode in a matter of seconds.

Another important feature of the present invention is that the driver can confirm that the system is operating by a quick visual inspection of the doors from the interior of the vehicle. The shield of my new locking system is green while the lock button is of a contrasting color, such as gray, metallic or chrome, so that the color of the lock button will be clearly displayed when the locking system is in its normal lock mode, and the shield will cover the lock button and display "green" when the locking system is positioned in its guard lock mode to provide a visual indication of the lock mode within the vehicle.

Among the several objects of this invention may be noted the provision of an improved child-safety door locking system for an automobile which prevents a child from unlocking the door from the inside; the provision of such a door locking system which permits the locked door to be unlocked without exiting the automobile to do so; the provision of such a door locking system which can be activated remotely from the door (e.g., at the front doors); the provision of such a door locking system which can be deactivated for normal locking and unlocking operation of the door; the provision of such a door locking system which visually indicates within the interior of the automobile whether the locking system is in a guard lock mode or normal lock mode; the provision of such a door locking system which is inexpensive; the provision of such a door locking system which is readily made as standard equipment on an automobile; and the provision of such a door locking system which is easy to manufacture and to use.

In general, a door locking system of this invention comprises an automobile door with an interior door panel, a latch, a handle capable of operating the latch to latch and unlatch the door, and a locking mechanism operable to lock and unlock the latch. The door handle is incapable of operating to unlatch the door when the locking mechanism locks the latch. The child-safety door locking system is capable of being selectively switched between a normal lock mode in which the door can be manually locked and unlocked, and a guard lock mode in which the door cannot be manually unlocked. The door locking system also comprises a lock button and a lock rod connecting the lock button to the locking mechanism of the door. The lock button is mounted on the lock rod at an end generally opposite the locking mechanism and extends out from an opening in the interior door panel for accessibility in manually moving the lock button relative to the door panel between a locked position in which the latch on the door is locked and an unlocked position in which the latch on the door is unlocked. A shield is movable relative to the interior door panel and the lock button. Adjustable mounting structure associated with the shield is provided for moving the shield relative to the door panel between a retracted operative position corresponding to the normal lock mode and an extended inoperative position corresponding to the guard lock mode. In the inoperative position the shield is recessed within the opening of the door panel whereby in the locked position the lock button may be manually grasped and moved to its unlocked position. In the operative position the shield extends outward of the opening in the door panel a distance so that the lock button is shielded in its locked position to prevent access to the lock button for manual movement to its unlocked position.

Other objects and features will be in part apparent and in part pointed out hereinafter.

BRIEF DESCRIPTION OF THE DRAWINGS

Corresponding parts are indicated by corresponding reference numerals throughout the several views of the drawings.

DETAILED DESCRIPTION OF THE PREFERRED EMBODIMENTS

Figure 1:
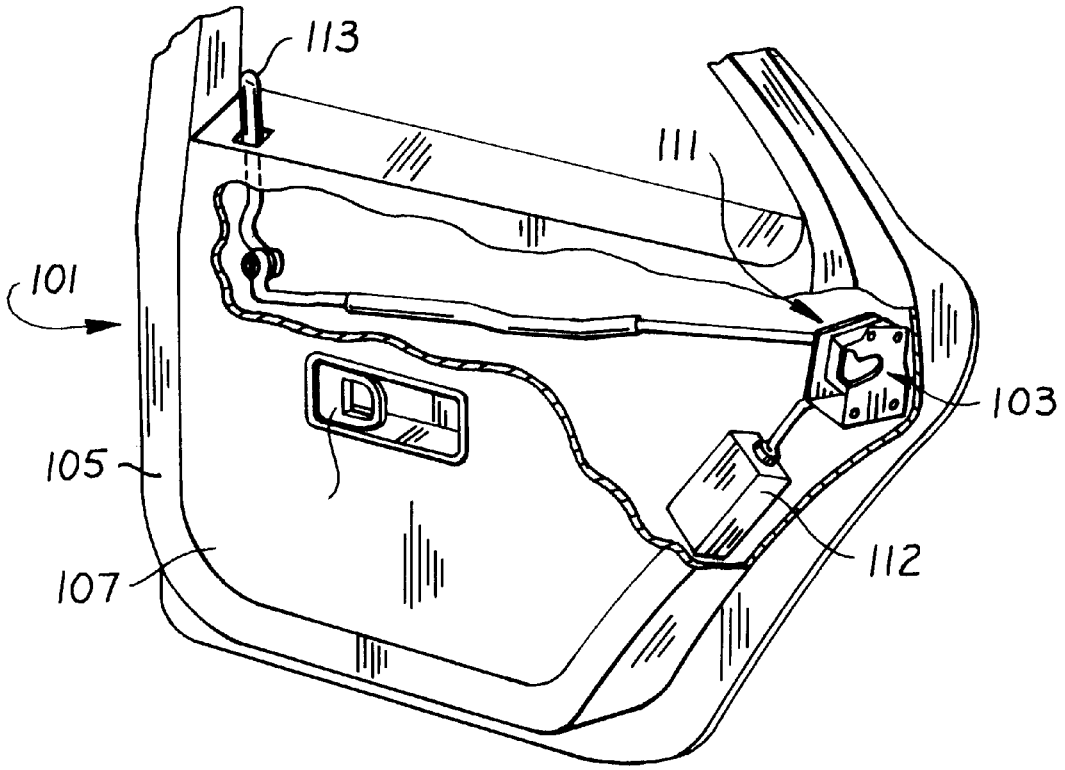
FIG. 1 is a perspective view of an automobile door including a child-safety locking system of a first embodiment including a lock button type manual lock actuator, a door latch, and a power lock actuator.

Now referring to the drawings, specifically FIG. 1, the reference numeral 101 refers generally to a rear or passenger side door of an automobile. A latch, generally indicated at 103 is mounted on the inside of a door frame 105. When the door 101 is closed, the latch 103 engages an automobile frame (not shown) on which the door is mounted to secure the door closed. To open the door 101, the latch 103 is unlatched from the automobile frame. An interior door panel 107 covers the door frame 105. A handle 109 mounted on the interior door panel 107 is connected to the latch 103 in a conventional manner such that it operates to latch and unlatch the door 101. A locking mechanism, shown generally at 111, is connected to the latch 103 such that it is capable of locking and unlocking the latch. When the locking mechanism 111 is in a locked position, it overrides the connection between the handle 109 and the latch 103 so as to render the handle incapable of unlatching the door 101. The construction of the locking mechanism 111 and latch 103 to prevent the handle 109 from being used to unlatch the door 101 when it is locked is well known to those of ordinary skill in the art and will not be described herein. Attached to the locking mechanism 111 is a manual lock actuator 113 extending through the interior door panel 107 to allow manual actuation of the locking mechanism 111 to lock and unlock the latch 103.

Figure 14:
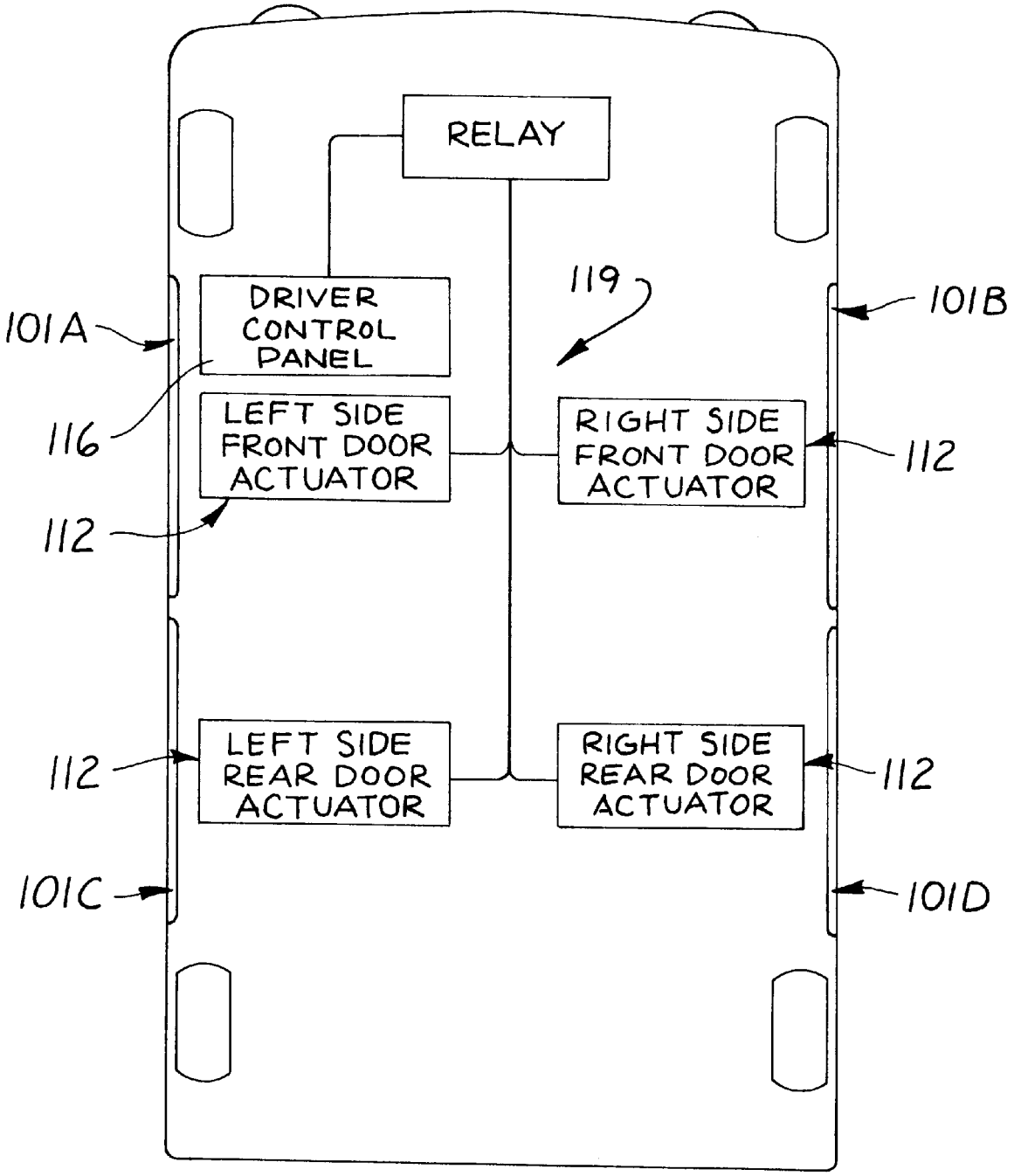
FIG. 14 is a schematic illustrating a power locking system used in the present invention.

An important feature of the locking system, in combination with the manual lock actuator 113 and door panel 107, is a power locking system (generally indicated at 119) of the automobile shown schematically in FIG. 14. The power locking system 119 includes a power lock actuator, shown generally at 112, mounted on each of the four doors (designated 101, 101A, 101B, and 101C) of the automobile. The power lock actuator 112 is used to automatically move the locking mechanism 111 to lock and unlock the latch 103. The power lock actuators 112 are connected by electrical wires to a control panel 116 located near the driver's seat. By toggling a switch (not shown) on the control panel 116, the driver is capable of locking and unlocking all of the doors 101—101C. As incorporated in the various embodiments of the locking system described hereinafter, the power locking system 119 is the only means of moving the locking mechanism 111 to unlock the latch 103 on the door 101 when the manual lock actuator 113 is in the locked position in the guard lock mode.

There are seven embodiments of the invention disclosed in the figures contained herein. For ease of cross-referencing between embodiments, the first digit of each reference number will correspond to the embodiment shown. The last two digits of each reference number will correspond to the specific item, such that corresponding items appearing in different embodiments are consistently referenced with the only difference in reference numbers being the first digit.

As shown in FIGS. 1–3B, the child-safety locking system of the first embodiment includes a lock button type manual lock actuator 113 screwed onto the end of a lock rod 114. The lock button 113 is generally cylindrical in shape and has an internally threaded hole 115 extending up from its bottom for threading onto a threaded end of the lock rod 114 in an opening 117 in the interior door panel 107. The other end of the lock rod 114 is connected to the locking mechanism 111 such that when the lock button 113 is pushed down to its locked position (FIG. 2B) the locking mechanism locks the latch 103, and when the lock button 113 is pulled up to its unlocked position (FIG. 2A) the locking mechanism unlocks the latch.

Figure 2A:
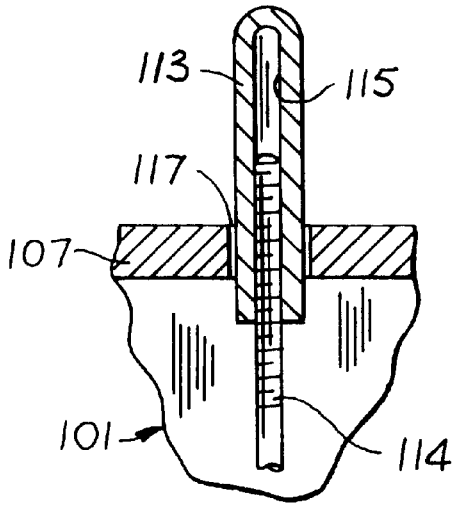
FIGS. 2A and 2B are fragmentary vertical sections of the door showing the lock button in a normal lock mode in its unlocked and locked positions, respectively.
Figure 2B:
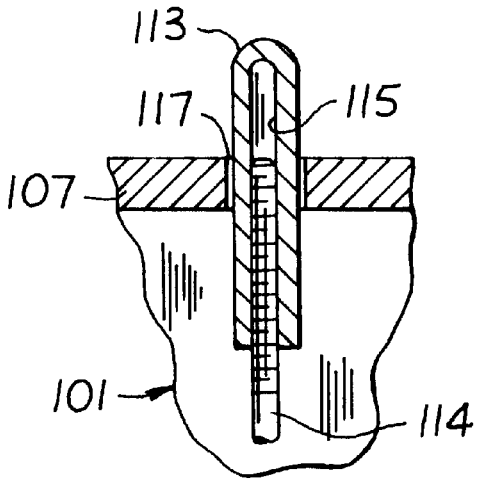
Figure 3A:
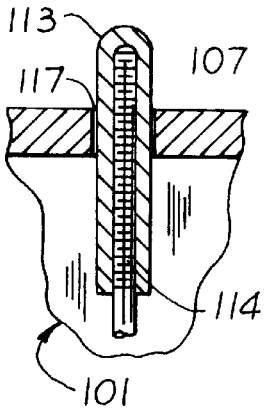
FIGS. 3A and 3B are fragmentary vertical sections of the door showing the lock button in a guard lock mode in its unlocked and locked positions, respectively.
Figure 3B:
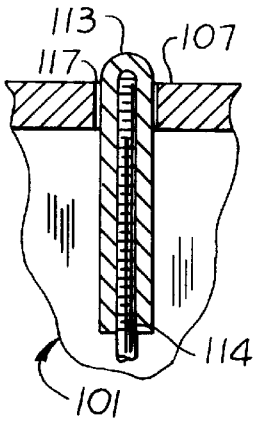

The child-safety locking system of the first embodiment is capable of being selectively switched between a normal lock mode (FIGS. 2A and 2B) and a guard lock mode (FIGS. 3A and 3B). The lock button 113 of the first embodiment is made sufficiently long so that enough threads in the lock button are engaged with the threads of the lock rod 114 when the lock button is screwed only about half way down on the lock to secure the lock button on the lock rod. As shown in FIG. 2B, the lock button 113 projects out of the opening 117 in the interior door panel 107 in its locked position a distance such that the lock button may be manually grasped and moved back to its unlocked position (FIG. 2A).

To switch to its guard lock mode of operation, the lock button 113 is fully screwed onto the lock rod 114 as shown in FIGS. 3A and 3B. When the lock button 113 is in the unlocked position (FIG. 3A), the lock button extends up from the top of the interior door panel 107 as before. However, when pushed down to its locked position (FIG. 3B), the lock button 113 is almost fully recessed through the opening 117 in the top of the interior door panel 107. The lock button 113 and opening 117 in the door panel 107 are sized so that there is very little space between the lock button and the periphery of the opening. Thus in the guard lock mode, the lock button 113 cannot be accessed manually for moving the lock button back to its unlocked position. It is envisioned that structure (not shown) could be provided for releasably fixing the lock button 113 on the lock rod 114 in the normal lock mode and the guard lock mode.

It will be noted that the interior door panel 107 surrounding the opening 117 in which the lock button 113 is positioned is solid. Thus, there are no other openings which provide access to the lock button 113 for manually moving it from its locked position in the guard lock mode to an unlocked position. In that regard, the present invention differs from my prior inventions, described above, in which a slot provided an opening in addition to the opening into which the manual lock actuator recessed for access to the lock button to manually move the lock button back to an unlocked position with the end of a thin, rigid object such as a key. In the present invention there is no opening in addition to the opening 117 so it would not be possible to use a key or similar object to access the lock button 113 in the locked position to manually return it to the unlocked position.

Figure 4A:
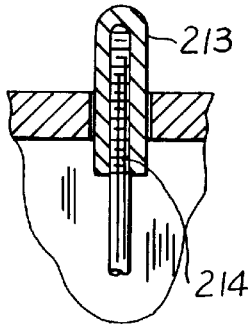
FIGS. 4A and 4B are fragmentary vertical sections of the door, but showing a child-safety locking system of a second embodiment which always operates in the guard lock mode.
Figure 4B:
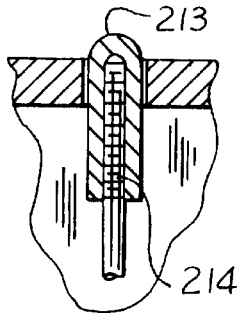

A second embodiment of the child-safety locking system shown in FIGS. 4A and 4B comprises a lock button 213 which is substantially shorter than the lock button 113 of the first embodiment so that the lock button 213 operates solely in the guard lock mode. The lock button 213 of the second embodiment can be secured on the lock rod 214 only when the lock button is screwed all the way down onto the lock rod. It will be noted that the lock rod 114 of the first embodiment preferably has more threads than the lock rod 214 of the second embodiment.

Figure 5:
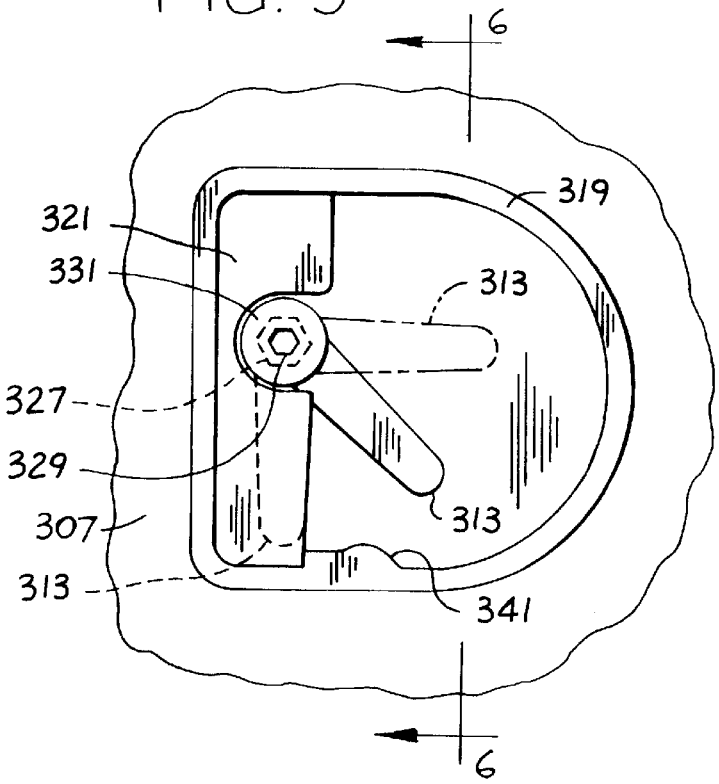
FIG. 5 is a fragmentary elevation of a door showing a lever type manual lock actuator incorporating a child-safety locking system of a third embodiment of the present invention.
Figure 6:
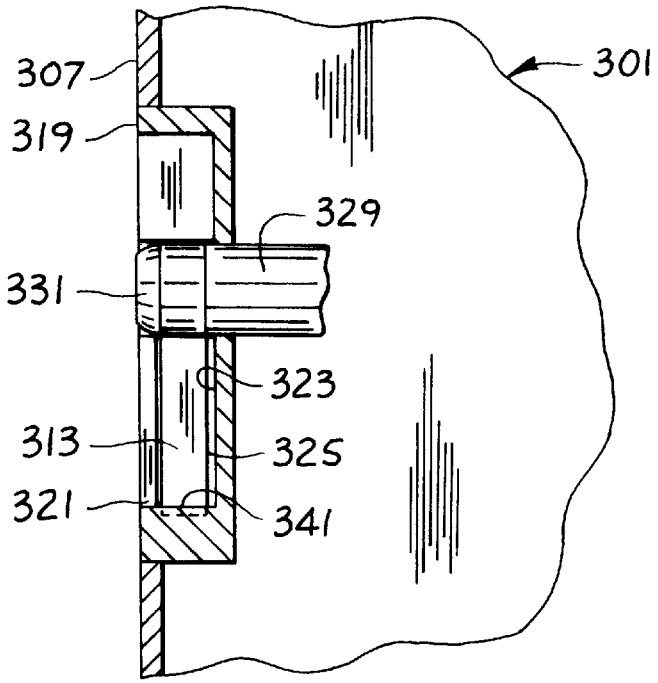
FIG. 6 is a fragmentary section taken in the plane including line 6—6 of FIG. 5 but showing the lock actuator in a guard lock mode in its locked position.
Figure 7:
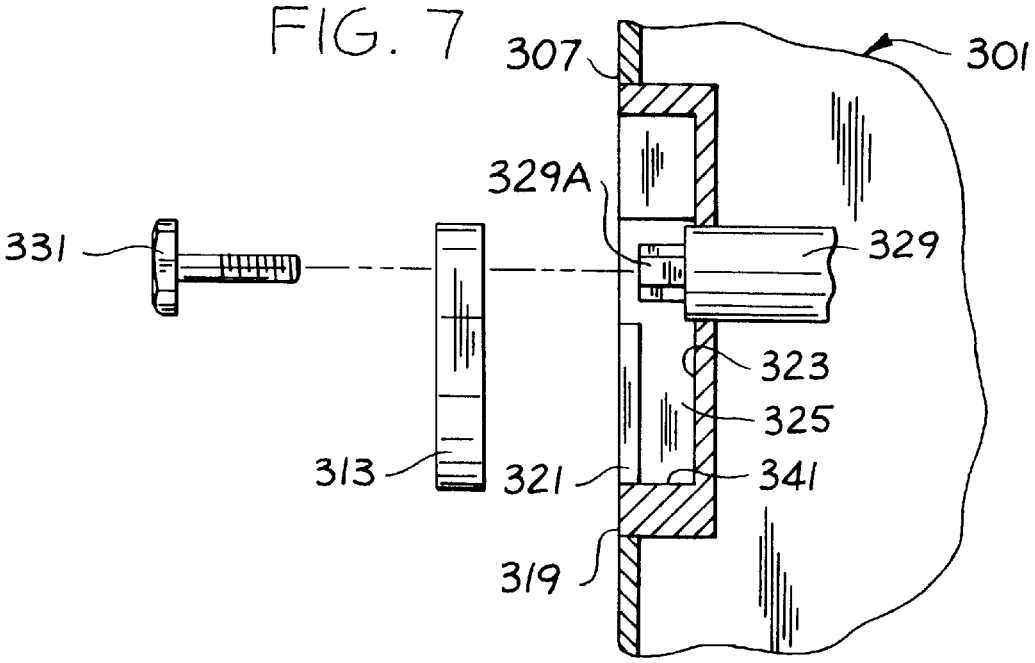
FIG. 7 is similar to FIG. 6 but showing a cap screw and lever exploded from a lock rod and the manual lock actuator.

Referring now to FIGS. 5–7, a child-safety locking system of a third embodiment is shown to comprise a lock lever type manual lock actuator 313 mounted on the side of the interior door panel 307 in a locking frame 319 (constituting part of the door panel in this embodiment) which is recessed into the door panel. The locking frame 319 includes a shield 321 which defines a pocket 323 (FIGS. 6 and 7) in which the lock lever 313 may be received. The pocket 323 has an opening 325 through which the lock lever 313 may enter the pocket. The opening 325 and lock lever 313 are sized so that when the lock lever is in the pocket 323, there is little space between them. Thus, a finger cannot be inserted into the pocket 323 to move the lock lever 313 back out of the pocket once it enters. The lock lever 313 has an octagonal opening 327 at its inner end which is sized for receiving an octagonally shaped end 329A of a lock stud 329 such that the lock lever and lock stud are connected for conjoint rotation about the longitudinal axis of the lock stud. A cap screw 331 fastens the lock lever 313 on the lock stud 329, which extends into the interior of the door for connection, by way of a lock rod to the locking mechanism (not shown). Rotation of the lock lever 313 operates the locking mechanism to lock and unlock the latch (not shown).

The child-safety locking system of the third embodiment is also capable of switching between a normal lock mode and a guard lock mode. The cooperating octagonal opening 327 in the lock lever 313 and octagonal end 329A of the lock stud 329 permit the lock lever to be fixed in several angular positions on the lock stud. In the normal lock mode, the lock lever 313 is fastened to the lock rod 329A by the cap screw 331 such that the lock lever is secured in a first angular orientation relative to the lock stud 329. In the first angular orientation, the lock lever 313 remains outside of the pocket 323 in both its locked and unlocked position. The unlocked position of the lock lever 313 mounted on the lock stud 329 is shown in phantom lines in FIG. 5. The locked position of the lock lever 313 in the first orientation is illustrated in solid lines. Thus, it may be seen that the lock lever 313 is readily manually accessible in its locked position in the normal lock mode to be moved back to its unlocked position.

To operate in the guard lock mode, the cap screw 331 and lock lever 313 are removed from the lock stud 329 in the unlocked position of the lock lever (FIG. 7). The lock lever 313 is turned in a clockwise direction toward the shield 321 to a second angular orientation relative to the lock stud 329, and placed back onto the lock stud. The cap screw 331 is reapplied to the lock stud 329 to secure the lock lever 313 in the second angular orientation. In the unlocked position of the lock lever 313 in the guard lock mode, the lever has the position shown in solid lines in FIG. 5., where it is accessible to be pushed in a clockwise direction to its locked position (shown in hidden lines in FIG. 5) in the pocket 323 defined by the shield 321. As shown in FIG. 6, the close spacing between the lock lever 313 and the shield 321 prevents a finger or other object from being inserted through the opening 325 past the lock lever to move it back to the unlocked position. Thus, the door 101 cannot be manually unlocked in the guard lock mode.

A hump 341 in the lower part of the locking frame 319, located just in front of the opening 325, blocks any attempt to insert a finger underneath the lock lever 313 in its locked position to move it manually back to its unlocked position. It will be noted that the shield 321 and locking frame 319 are solid in the area surrounding the opening 325 so that there is no other opening besides the opening giving access to the lock lever 313. Thus, referring to FIG. 1 and FIG. 14, the only way to unlock the door 101 in the guard lock mode of the locking system is to use the power locking system 119 controlled from the control panel 116 on the driver's side front door.

Figure 8:
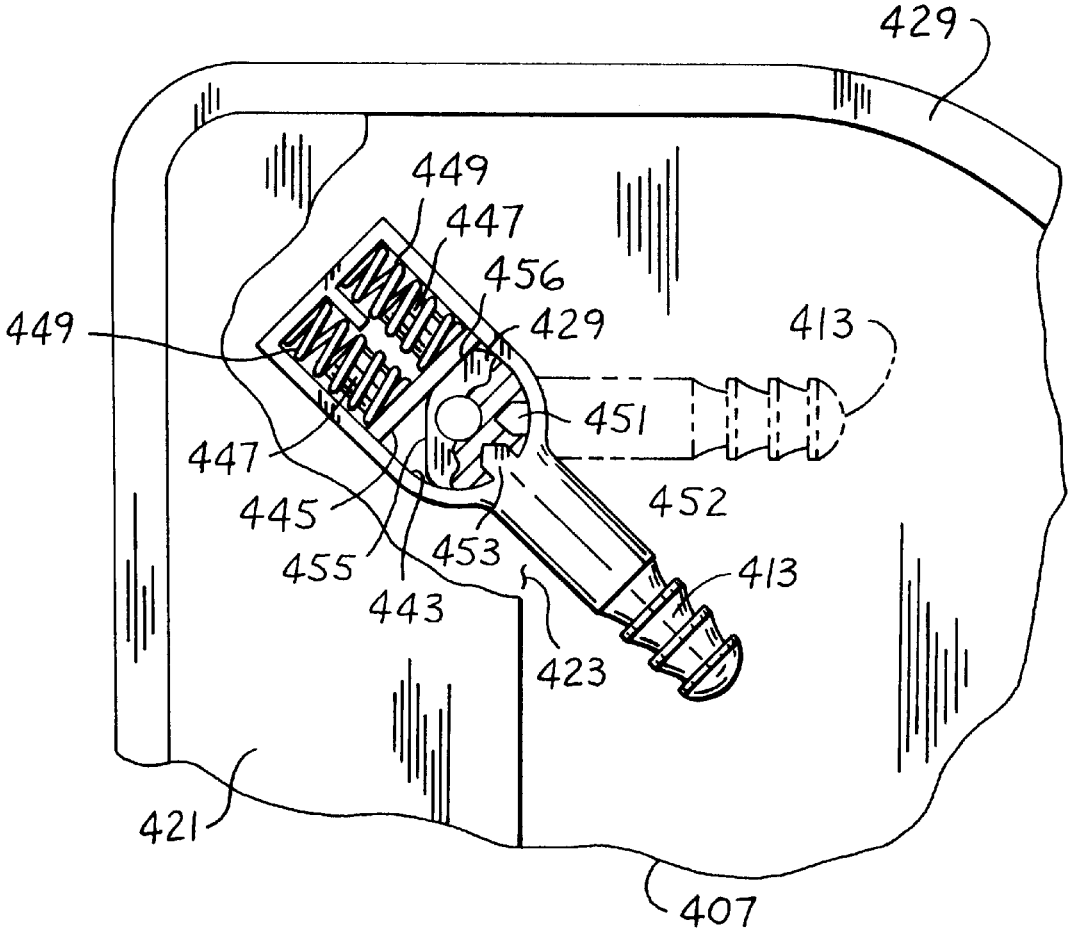
FIG. 8 is an elevation of another lever type manual lock actuator of a child-safety locking system of a fourth embodiment with parts of its shield broken away to show internal construction.

A fourth embodiment of the child-safety locking system (FIG. 8) has a lock lever 413 similar to that of the third embodiment, but has adjustable mounting structure which is more convenient than the cap screw 331 of the third embodiment. The fourth embodiment permits changing the position of the lock lever 413 from the first angular orientation (corresponding to the normal lock mode) to the second angular orientation (corresponding to the guard lock mode) without removing the lock lever from the lock stud 429. The lock lever 413 is shown in its unlocked positions in FIG. 8. The solid line representation illustrates the lock lever 413 in the guard lock mode, and the phantom line representation illustrates it in the normal lock mode.

The lock lever 413 may be selectively clamped onto the lock stud 429 in either the guard lock or normal lock mode. In that regard, one end of the lock lever is formed with an opening 443 sized to receive the end of the lock stud 429. One wall of the opening 443 is defined by a clamp 445 which is slidably mounted on the lock lever 413 for movement generally longitudinally of the lock lever. The side of the clamp 445 opposite the lock stud 429 has a pair of nubs 447 which each receive an end of a respective coil compression spring 449 bearing against the clamp and against a reaction surface of the lock lever generally opposite the clamp. The springs 449 bias the clamp 445 into gripping engagement with the lock stud 429 and are selected to be sufficiently strong to prevent a small child from being able to change the orientation of the lock lever 413 relative to the lock stud. As clamped onto the lock stud 429 in either orientation, the lock lever 413 and lock stud are rotatable conjointly about the axis of the lock stud.

The lock stud 429 has a first aperture 451 and a second aperture 452 sized to receive a locator pin 453 on the lock lever 413 to positively locate the lock lever in the first and second angular orientations relative to the lock stud corresponding to the normal lock and guard lock modes, respectively. The lock stud 429 has two flat surfaces (designated 455 and 456, respectively), a first of which (surface 455) is engaged by the clamp 445 in the normal lock mode of the system and a second of which (surface 456) is engaged by the clamp in the guard lock mode of the system. The flat surfaces 455, 456 permit a secure, positive location of the lock lever 413 relative to the lock stud 429.

The lock lever 413 is adjusted to change the locking system from a normal lock mode to a guard lock mode by pulling outward on the lock lever at its end opposite the lock stud 429 to unseat the locator pin 453 from the first aperture 451. The lock lever 413 is then rotated clockwise relative to the lock stud 429 about the axis of the lock stud until the locator pin 453 is in registration with the second aperture 451. The lock lever 413 is released and the springs 449 and clamp 445 operate to seat the locator pin 453 in the second aperture 452. The lock lever 413 is now joined with the lock stud 429 in the guard lock mode of the locking system. As before in the guard lock mode, the lock lever 413 may be returned to its unlocked position only by operation of the power locking system 119. It is apparent that the foregoing steps may be reversed to change the locking system back to the normal lock mode.

Figure 9:
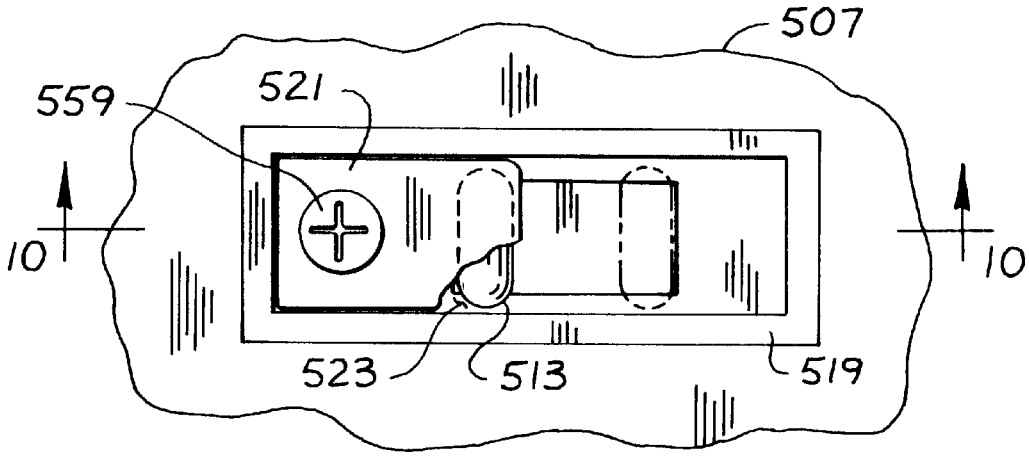
FIG. 9 is a fragmentary elevation of a door showing a slide type manual lock actuator, and a child-safety locking system of a fifth embodiment.
Figure 10:
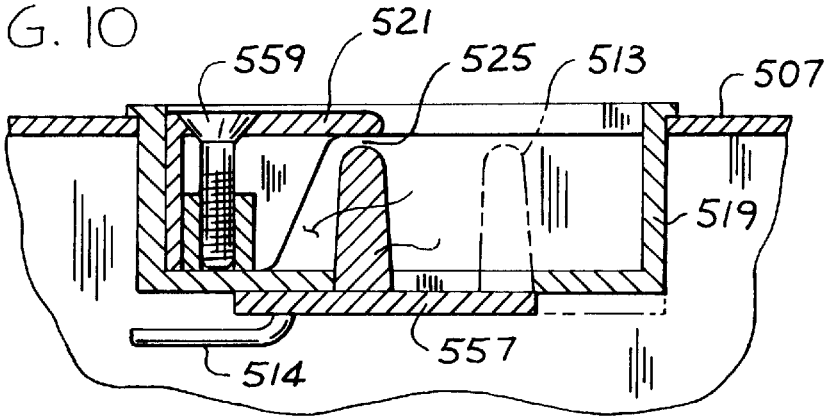
FIG. 10 is a section taken in the plane including line 10—10 of FIG. 9.

A child-safety locking system of a fifth embodiment is shown in FIGS. 9–10 to include a slide type manual lock actuator 513 mounted to the side of the interior door panel 507 by a locking frame 519 recessed into the door panel. The locking frame 519 constitutes part of the interior door panel 507 in this embodiment. A slide 513 extending outward from the locking frame 519 is connected to a slide plate 557 behind the locking frame. The slide plate 557 is connected to the locking mechanism 111 by a lock rod 514 such that the slide 513 can be moved translationally along the locking frame 519 to lock and unlock the latch 103. A shield 521 connected to the locking frame 519 by a screw 559 defines with the locking frame a pocket 523 for receiving the slide 513 in its locked position. The pocket 523 has an opening 525 through which the slide 513 passes into the pocket. The opening 525, pocket 523 and slide 513 are sized such that it is not possible to grasp the slide with one's fingers in the locked position. Moreover, the slide 513 cannot be manipulated with a key or similar thin, rigid object in its locked position to move it back to the unlocked position. The slide 513 can be moved back to its unlocked position by operation of the power locking system 119.

Figure 11:
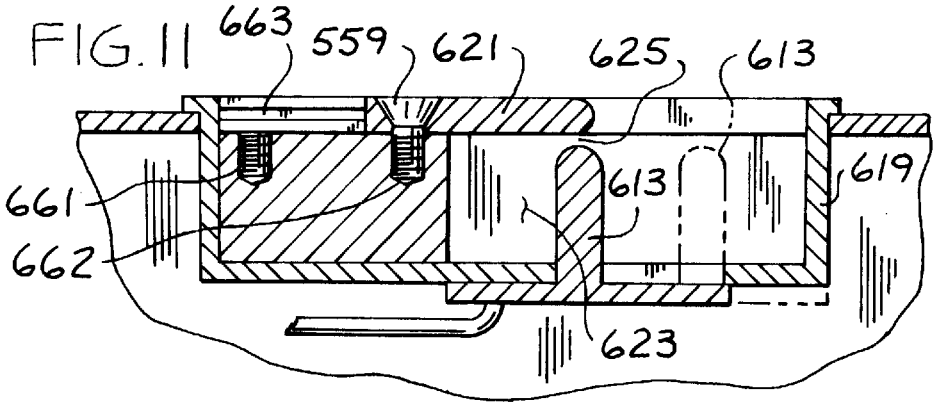
FIG. 11 is section similar to FIG. 10 but showing a child-safety system of a sixth embodiment in a guard lock mode.
Figure 12:
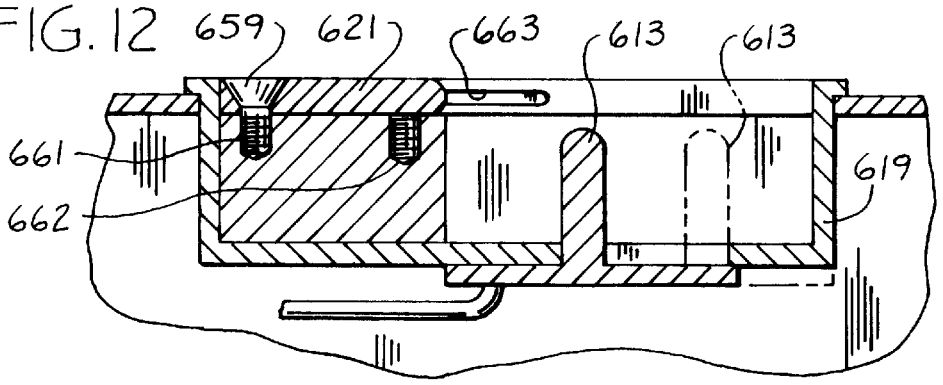
FIG. 12 is the section of FIG. 11 but showing the child-safety locking system in a normal lock mode.

It is possible to convert the locking system of the fifth embodiment to operate in a normal lock mode by removing the shield 521. To do this, the screw 559 is taken out and the shield 521 is removed. However, a sixth embodiment of the present invention shown in FIGS. 11 and 12 is more conveniently switched between guard lock and normal lock modes. The locking system of the sixth embodiment is substantially the same as that of the fifth embodiment except for the construction of the shield 621. The shield 621 of the sixth embodiment is slidable longitudinally of the locking frame 619 between the guard lock mode (FIG. 11) and the normal lock mode (FIG. 12). The shield 621 has tabs (not shown) on each edge which ride in grooves 663 (only one is shown) in the locking frame 619. The shield 621 is secured in either position by a screw 659 received through a single opening in the shield and either of two openings (designated 661 and 662, respectively) in the locking frame 619 corresponding to the guard lock and normal lock modes, respectively. Thus, it may be seen that there are no unused parts to be stored in either the guard lock or normal lock mode because the shield 621 remains attached to the door. In the guard lock mode, the shield 621 cooperates with the locking frame 619 to define a pocket 623 and opening 625 as in the fifth embodiment.

Figure 13:
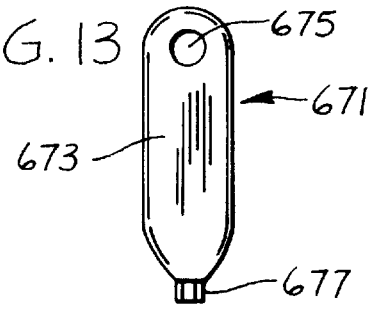
FIG. 13 is an elevation of a key for use in changing the child-safety system of the sixth embodiment between the guard lock and normal lock modes.

Switching the locking system of the sixth embodiment from one lock mode to the other is facilitated by the provision of a hex head key, indicated generally at 671 in FIG. 13, which can be used as a screwdriver to loosen and tighten the screw 659. The key 671 has a wide body 673 which can be easily gripped for turning the key. A hole 675 in the end of the body 673 opposite a head 677 is sized to receive a key chain (not shown). Thus, the key 671 can be conveniently carried around to be used to change the lock mode of the locking system. It is to be understood that the key 671 could also be used with any of the locking systems employing screws to hold the locking system in one lock mode or the other.

A seventh embodiment of the child-safety locking system (FIGS. 15–22) has a lock lever 713 similar to that of the third and fourth embodiments. The child-safety locking system of this embodiment incorporates my novel "Child-Key-Guard Unit". In this embodiment a key lock, generally indicated at 772, and lock housing 774 define the adjustable mounting structure for adjusting the mode of the locking system between the normal lock mode and the guard lock mode without removing the lock lever from the lock stud 729. The lock lever 713 has a bore 773 extending therethrough sized for rotatably mounting the lock lever on the lock housing 774. This embodiment also provides for visually identifying which mode the locking system is in from inside the automobile.

The lock housing 774 (FIG. 17) is generally tubular and has an internally threaded connecting end 775 adapted for engagement with external threads of the lock stud 729 to operatively connect the lock housing with the locking mechanism (not shown) via the lock stud and lock rod (not shown, but substantially similar to the lock rod 114 of FIG. 1). Although the lock housing 774 is illustrated as a separate piece connected to the lock stud 729, the two may be formed as one piece, or the lock housing, lock stud and lock rod may all be formed as one piece. It is to be understood, for purposes of the claims, that the lock stud 729 is part of the lock rod. The lock housing 774 has an outer end 776 for housing the key lock 772, and an internal annular shoulder 777 defining a seat for the key lock within the housing. The internal annular shoulder 777 is spaced apart from the lock stud 729 when the housing is connected to the lock stud. An external annular shoulder 778 of the lock housing 774 defines a seat for the lock lever 713 when the lever is mounted on the housing. In this manner, the lock lever 713 is free of any connection with the lock housing 774 and is thus capable of rotating movement with respect to the lock rod. The housing 774 has a pair of internal channels 779, 780, each extending longitudinally between the internal annular shoulder 777 and outer end 776 of the housing. The channels 779, 780 correspond, respectively, to the normal lock mode and guard lock mode of the locking system. In the preferred embodiment, these channels 779, 780 are spaced apart approximately 45°. However, this spacing may vary without departing from the scope of the invention.

Figure 17:
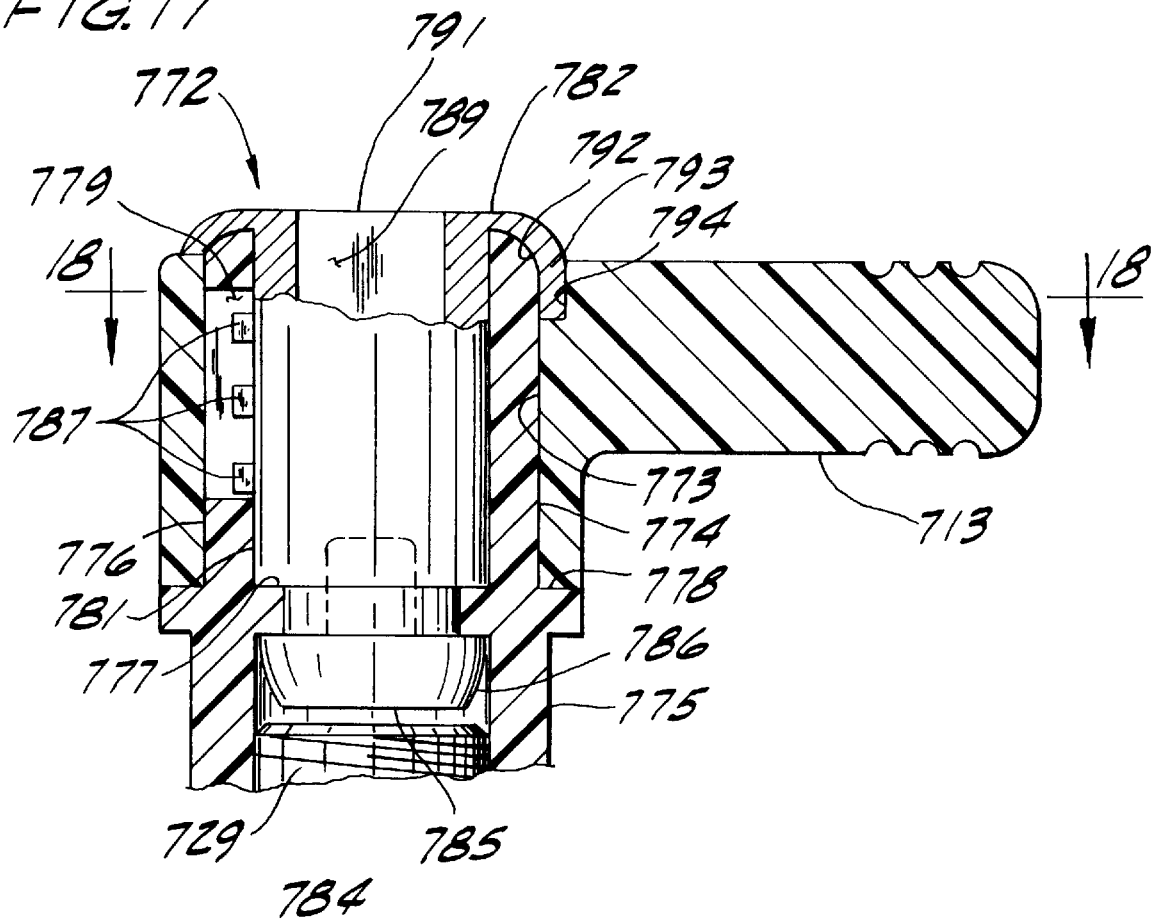
FIG. 17 is a fragmentary section of the lever type manual lock actuator of FIG. 15.
Figure 18:
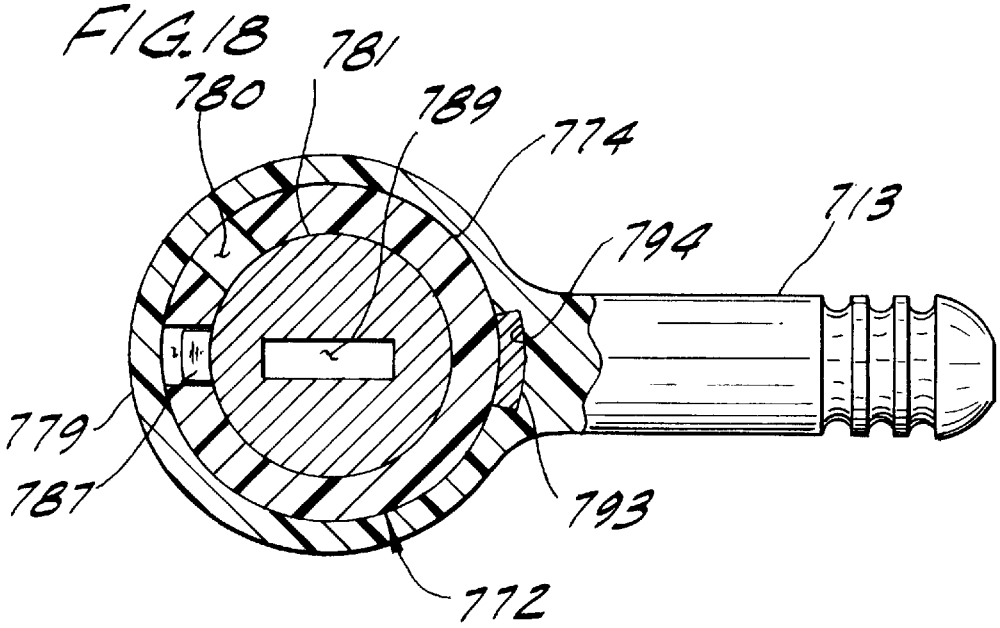
FIG. 18 is a fragmentary section of the lever type manual lock actuator of the seventh embodiment taken in the plane including line 18—18 of FIG. 17.

With reference to FIGS. 17 and 18, the key lock 772 comprises a lock cylinder 781 sized for seating within the lock housing 774 in closely spaced relationship with the housing, and a cap 782 integrally formed with the cylinder adapted for connection with the lock lever 713. The lock cylinder 781 corresponds closely in construction to a conventional wafer lock, such as the type of lock used in file cabinets and the like. However, pin locks and other suitable locks (not shown) may be used without departing from the scope of this invention. The lock cylinder 781 seats against the internal annular shoulder 777 of the housing and has a longitudinally extending threaded bore 784 therein. A suitable fastener, such as a screw 785 having a head 786 sized larger than the inner diameter of the internal annular shoulder 777, threadably engages the lock cylinder 781 with the shoulder positioned between the cylinder and the screw head to hold the cylinder against movement outward from the housing.

Wafers 787 (broadly "engaging members") within the lock cylinder 781 are adapted for transverse movement relative to the cylinder between an extended position in which the wafers extend outward from the cylinder and seat in one of the internal channels 779, 780 in the lock housing 774 to engage the key lock 772 with the lock housing (thereby connecting the lock lever 713 with the locking mechanism via the key lock and lock rod), and a withdrawn position in which the wafers are unseated from the channel and drawn into the cylinder so that the key lock is disengaged from the lock housing to allow movement of the lock lever and key lock relative to the lock rod. Springs (not shown) in the lock cylinder 781 bias the wafers 787 toward their extended position. It is contemplated that a set of internal slots (not shown) aligned longitudinally within the housing 774 corresponding respectively to each of the wafers 787 may be used in place of each internal channel 779, 780 so that each wafer is adapted for seating in an individual slot, without departing from the scope of this invention.

Figure 21:
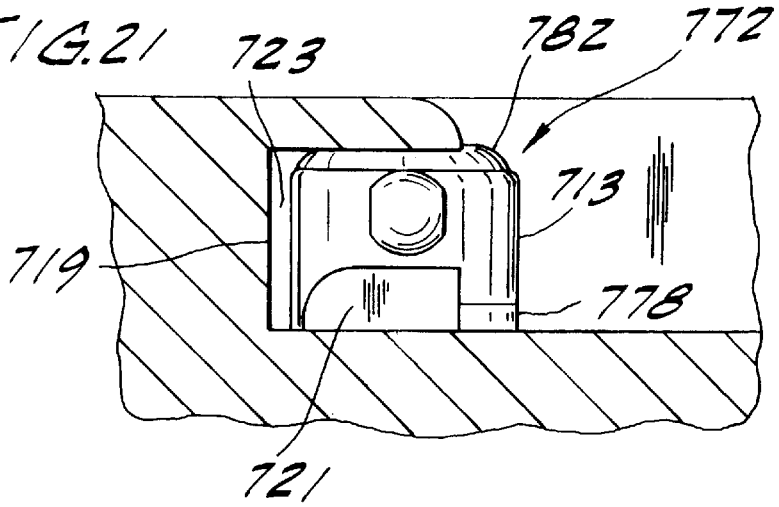
FIG. 21 is a fragmentary end view of the door of FIG. 15 but showing the child-safety locking system in a locked position in the guard lock mode.

The lock cylinder 781 has a key slot 789 (FIG. 18) therein for receiving a key 790 into the cylinder. The key 790 is configured for compressing the springs in the lock cylinder 781 upon insertion through the key slot 789 so that the wafers 787 are moved to their withdrawn position in the cylinder. As shown in FIG. 21, the key 790 is preferably a bi-directional key that can be inserted into the key slot 789 in either of the two possible orientations. The construction and operation of conventional wafer locks is well known in the industry and will not be further described herein.

Figure 20:
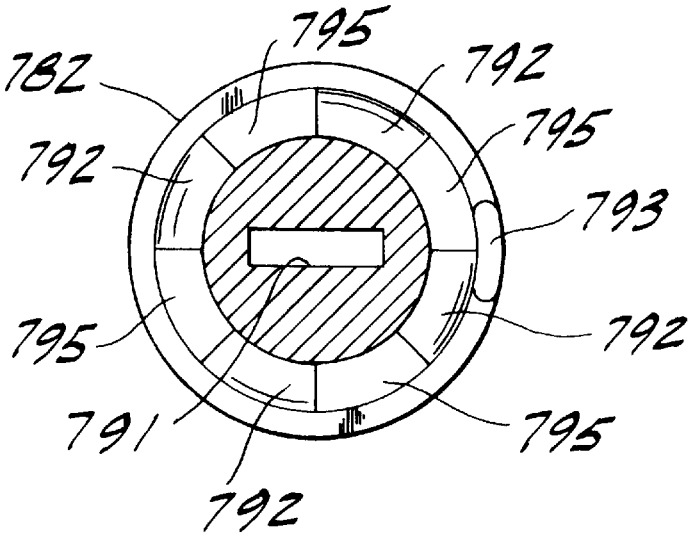
FIG. 20 is a bottom view of the cap of the lever type manual lock actuator of FIG. 15.
Figure 22:
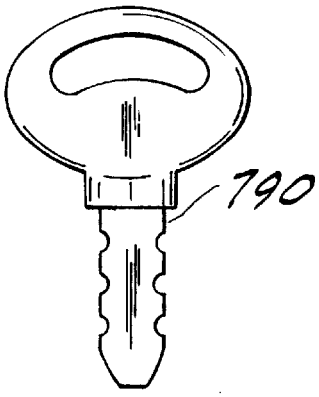
FIG. 22 is an elevation of a key for use in changing the child-safety system of the seventh embodiment between the guard lock and normal lock modes.

Referring to FIGS. 17 and 20, the cap 782 is integrally formed with the lock cylinder 781 and extends outward over the outer end 776 of the lock housing 774. A central opening 791 in the cap 782 provides access to the key slot 789. In the preferred embodiment shown in FIG. 17, the outer end 776 of the lock housing 774 seats in a groove 792 in the bottom of the cap 782. A tongue 793 extending from the cap 782 seats within a recess 794 in the lock lever 713 to fixedly connect the lock lever to the key lock 772. The cap 782 has four arcuate, spaced apart windows 795 therein (FIG. 20). These windows 795 are positioned over the outer end 776 of the lock housing 774 so that portions of the outer end of the housing are visible through the windows.

Figure 19:
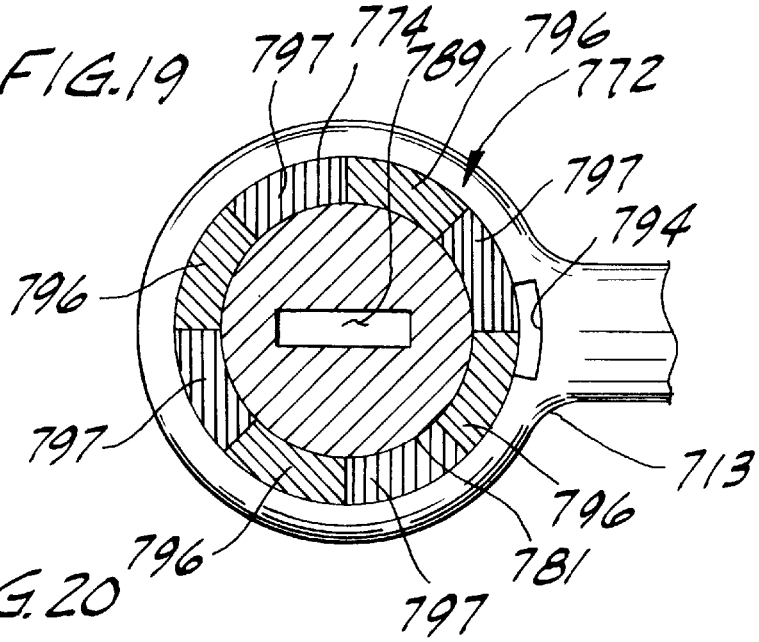
FIG. 19 is a top view of the lever type manual lock actuator of FIG. 15 with a cap removed to reveal internal structure.

The outer end 776 of the lock housing 774 is preferably colored with alternating arcuate color segments 796, 797, as shown in FIG. 19, corresponding to the normal lock mode and guard lock mode, respectively. For example, red colored segments 796 may correspond to the normal lock mode and green colored segments 797 may correspond to the guard lock mode. The windows 795 in the cap 782 are sized for displaying one of the respective colors 796, 797 while the cap covers the other of the colors, depending on the operating mode of the locking system, so that a person within the automobile can visually identify whether the locking system is in the normal lock mode or the guard lock mode.

Figure 15:
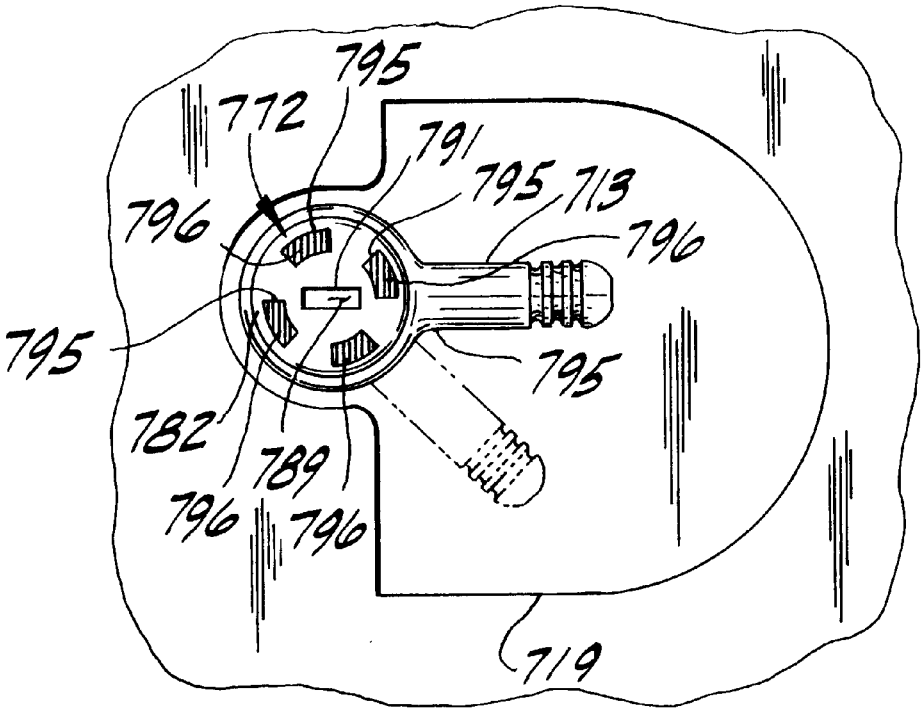
FIG. 15 is a fragmentary elevation of a door showing a child-safety locking system incorporating another lever type manual lock actuator of a seventh embodiment of the present invention showing the locking system in a normal lock mode.
Figure 16:
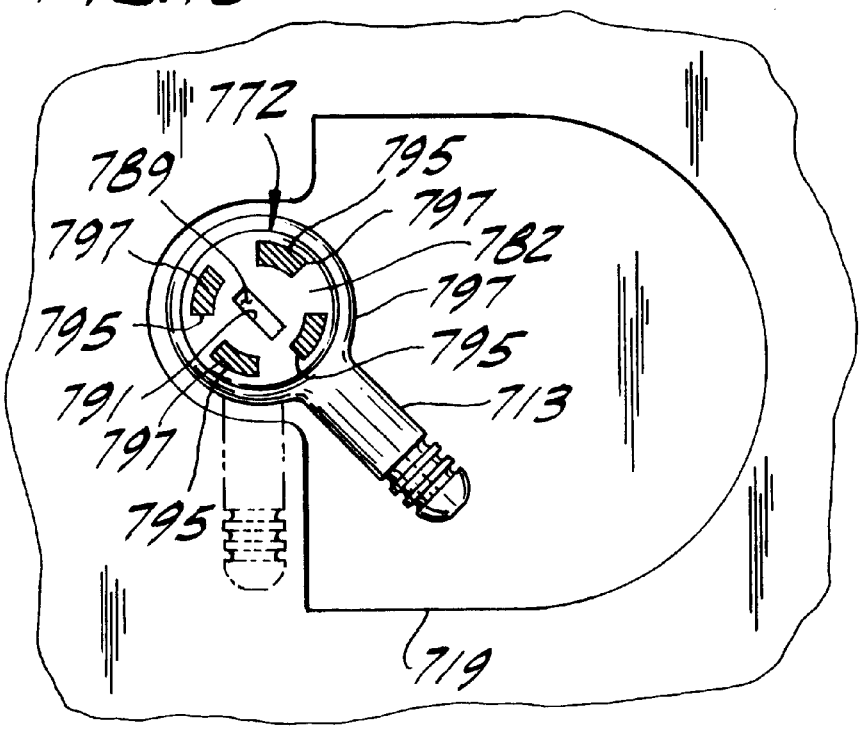
FIG. 16 is the fragmentary elevation of FIG. 15 but showing the child-safety locking system in a guard lock mode.

With reference to FIG. 15, when the locking system is in the normal lock mode, the wafers 787 in the lock cylinder 781 of the key lock 772 are in their extended position seated in the first internal channel 779 of the lock housing 774. The engagement of the wafers 787 in the channel 779 connects the key lock 772 and the lock lever 713 affixed thereto to the lock housing for conjoint movement. Thus, movement of the lock lever 713 between the unlocked position shown in solid lines in FIG. 15 and the locked position shown in phantom in FIG. 15 actuates the lock rod to lock and unlock the locking mechanism. The windows 795 in the cap 782 are aligned with the red arcuate color segments 796 of the outer end 776 of the lock housing 774 to indicate that the locking system is in the normal lock mode. Because the lock lever 713, key lock 772 and lock housing 774 move conjointly, the same color 796 appears in the windows of the cap regardless of whether the lock lever is in the locked or unlocked position.

To change the locking system from the normal lock mode to the guard lock mode, the key 790 is inserted through the cap opening 791 and key slot 789 into the lock cylinder 781 of the key lock 772. Insertion of the key 790 compresses the springs inside the lock cylinder 781, thereby unseating the wafers 787 from the first internal channel 779 of the lock housing 774 and retracting the wafers from the channel into the cylinder. The key lock 772 is thus disengaged from the lock housing 774 (and hence disengaged from the locking mechanism), and the lock lever 713 and key lock 772 may be moved conjointly with respect to the lock rod by turning the key until the key lock abuts against a stop (not shown). The wafers 787 are now aligned with the second internal channel 780 in a position corresponding to the guard lock mode. Rotation of the key lock 772 with respect to the lock housing 774 also aligns the windows 795 in the cap 782 with the green arcuate color segments 797 of the free end 776 of the lock housing to indicate that the locking system is in the guard lock mode.

Removing the key 790 from the key lock 772 allows the compressed springs to push the wafers 787 to their extended position seated in the second internal channel 780. The engagement of the wafers 787 in the channel 780 again connects the key lock 772 and the lock lever 713 affixed thereto to the lock housing 774 for conjoint movement. Thus, movement of the lock lever 713 between the unlocked position unlocked position shown in solid lines in FIG. 16 and the locked position shown in phantom in FIG. 16 actuates the lock rod to lock and unlock the locking mechanism. Because the lock lever 713, key lock 772 and lock housing 774 move conjointly, the same color 797 appears in the windows 795 of the cap 782 regardless of whether the lock lever is in the locked or unlocked position. In the unlocked position, the lock lever 713 is inaccessibly positioned within the pocket 723 formed by the locking frame 719 and shield 721, and can be moved to its unlocked position only by using the power locking system 119 or by using the key 790 to adjust the lock lever back to the normal lock mode.

Figures 23, 24:
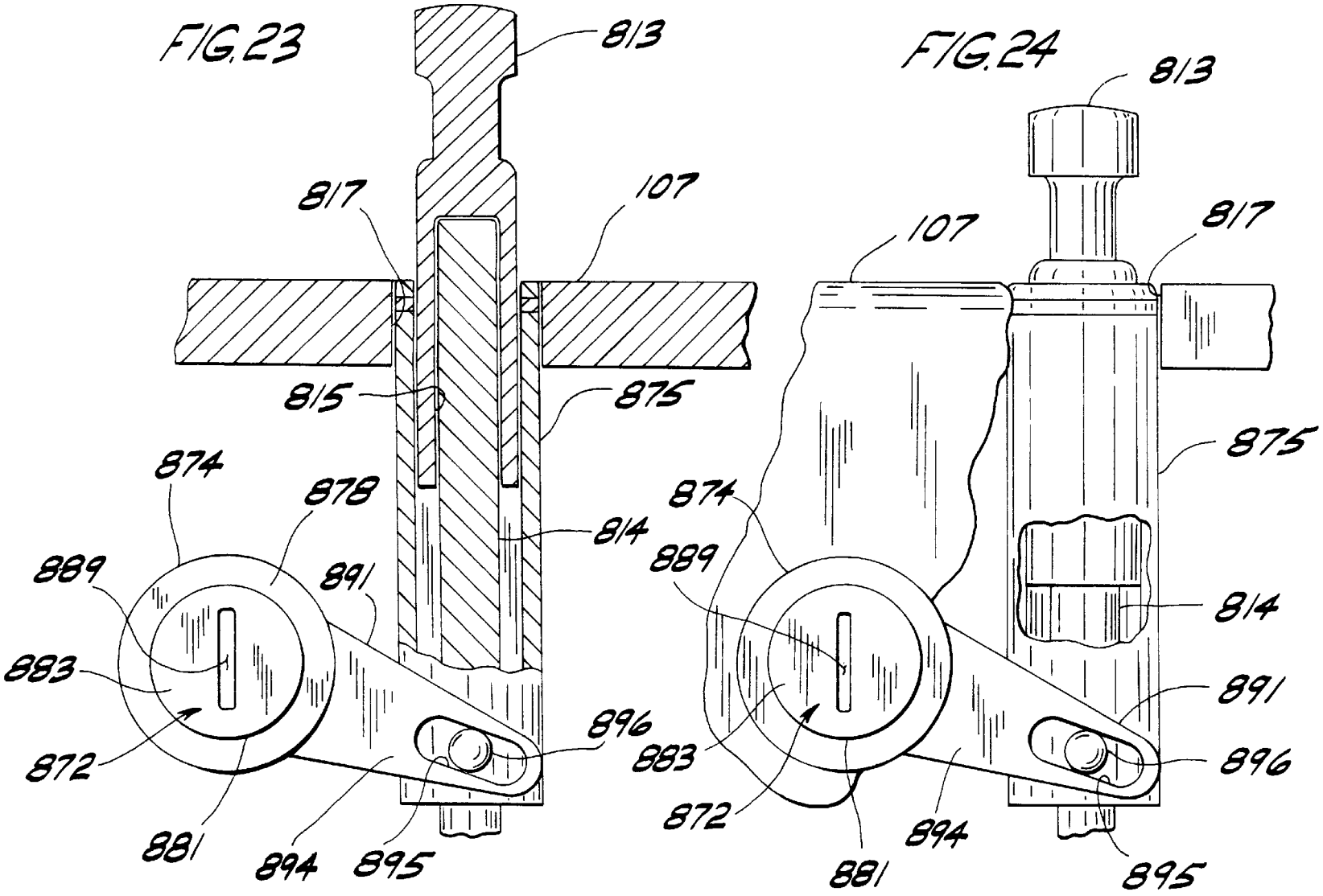
FIG. 23 is a fragmentary vertical section of a child-safety locking system of an eighth embodiment including a lock button type manual lock actuator and showing the locking system in a normal lock mode and the lock button in an unlocked position.
FIG. 24 is a fragmentary elevation of the door locking system of FIG. 23 showing the lock button in a locked position and with parts broken away to shown internal construction.

An eighth embodiment of the child-safety locking system (FIGS. 23–31) has a lock button 813 and lock rod 814 similar to that of the first and second embodiments. The location of the lock button 813 and lock rod 814 with respect to the interior door panel 107 and locking mechanism 111 may be essentially the same as shown in FIG. 1. However, the lock button 813 need not be adjustable on the lock rod 814 between normal lock and guard lock modes, as with the first and second embodiments. As shown in FIG. 23, the lock button 813 is generally cylindrical in shape and has an internal hole 815 extending up from its bottom for mounting on an end of the lock rod 814 in an opening 117 of an upward facing portion of the interior door panel 107. The other end of the lock rod 814 is connected to the locking mechanism 111 such that when the lock button 813 is pulled upward relative to the door panel 107 to its unlocked position (FIG.

23) the locking mechanism unlocks the latch 103 (FIG. 1), and when the lock button is pushed downward relative to the door panel to its locked position (FIG. 24) the locking mechanism locks the latch. While the lock button 813 is illustrated herein as being cylindrical, it is understood that the lock button may have a different cross-sectional shape without departing from the scope of this invention.

The child-safety locking system of this embodiment also incorporates my novel "Child-Key-Guard Unit" similar to that of the seventh embodiment in which a key lock, generally indicated at 872, and a lock housing 874 define adjustable mounting structure for adjusting the mode of the locking system between the normal lock mode and the guard lock mode without moving the lock button 813 relative to the lock rod 814. This embodiment also provides for visually identifying which mode the locking system is in from inside the automobile.

Figures 25, 26:
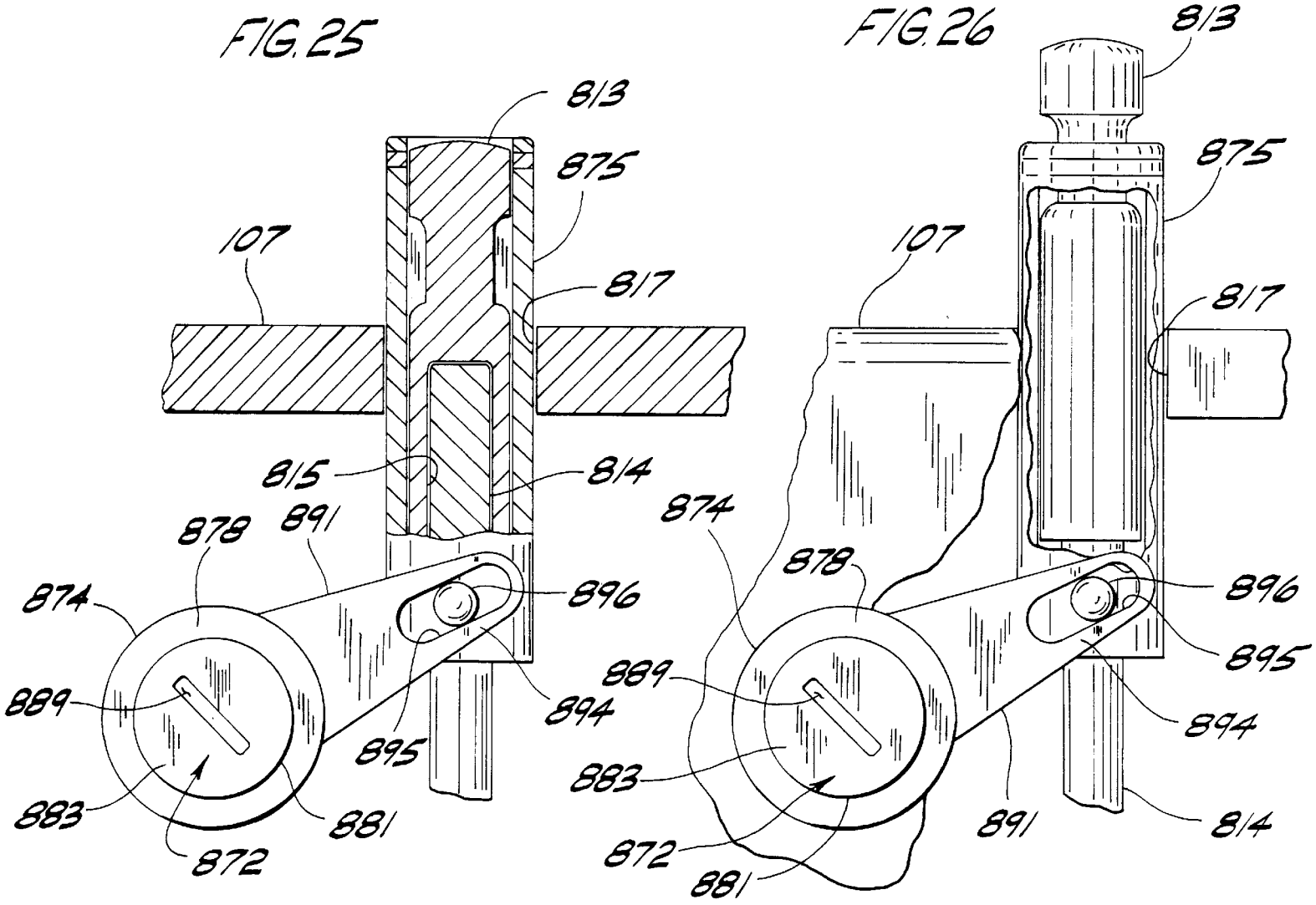
FIG. 25 is the fragmentary vertical section of FIG. 23 showing the door locking system in a guard lock mode and the lock button in a locked position.
FIG. 26 is the fragmentary elevation of FIG. 24 showing the door locking system in a guard lock mode and the lock button in an unlocked position.
Figure 28:
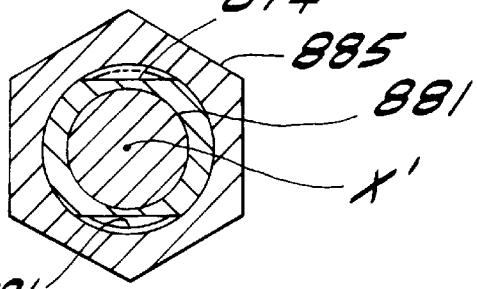
FIG. 28 is a cross-section of a key lock of the door locking system taken in the plane of line 28—28 of FIG. 27.

With reference to FIGS. 23–26, a generally tubular shield 875 is disposed vertically in the opening 117 of the upward facing portion of the interior door panel 107 around the lock button 813 and lock rod 814. As illustrated, the tubular shield 875 is cylindrical in accordance with the cylindrical shape of the lock button 813. However, the shield 875 may be of other shapes, depending on the shape of the lock button 813, without departing from the scope of this invention. The inner diameter of the shield 875 is sufficient to allow the lock button 813 and lock rod 814 to move vertically within the shield as the lock button is moved between its locked and unlocked position. The shield 875 is free of any fixed connection with the door panel 107, lock button 813 and lock rod 814. Thus, the shield 875 is capable of translating (e.g. vertical) movement relative to the door panel 107, lock button 813 and lock rod 814 between a retracted inoperative position (FIGS. 23 and 24) corresponding to the normal lock mode in which the shield is recessed into the opening 117 of the door panel and an extended operative position (FIGS. 25 and 26) corresponding to the guard lock mode in which the shield extends outward from the door panel opening. As shown in FIG. 26, the length of the shield 875 is sufficient so that in its operative position, the lock button 813 is recessed within the shield in its locked position where it is shielded against access to the lock button for manually moving the lock button to its unlocked position. The shield 875 is colored green so as to be visibly distinguishable from the lock button 813 so that a person within the interior of the automobile can visibly identify whether the shield is in its operative or inoperative position.

Figure 27:
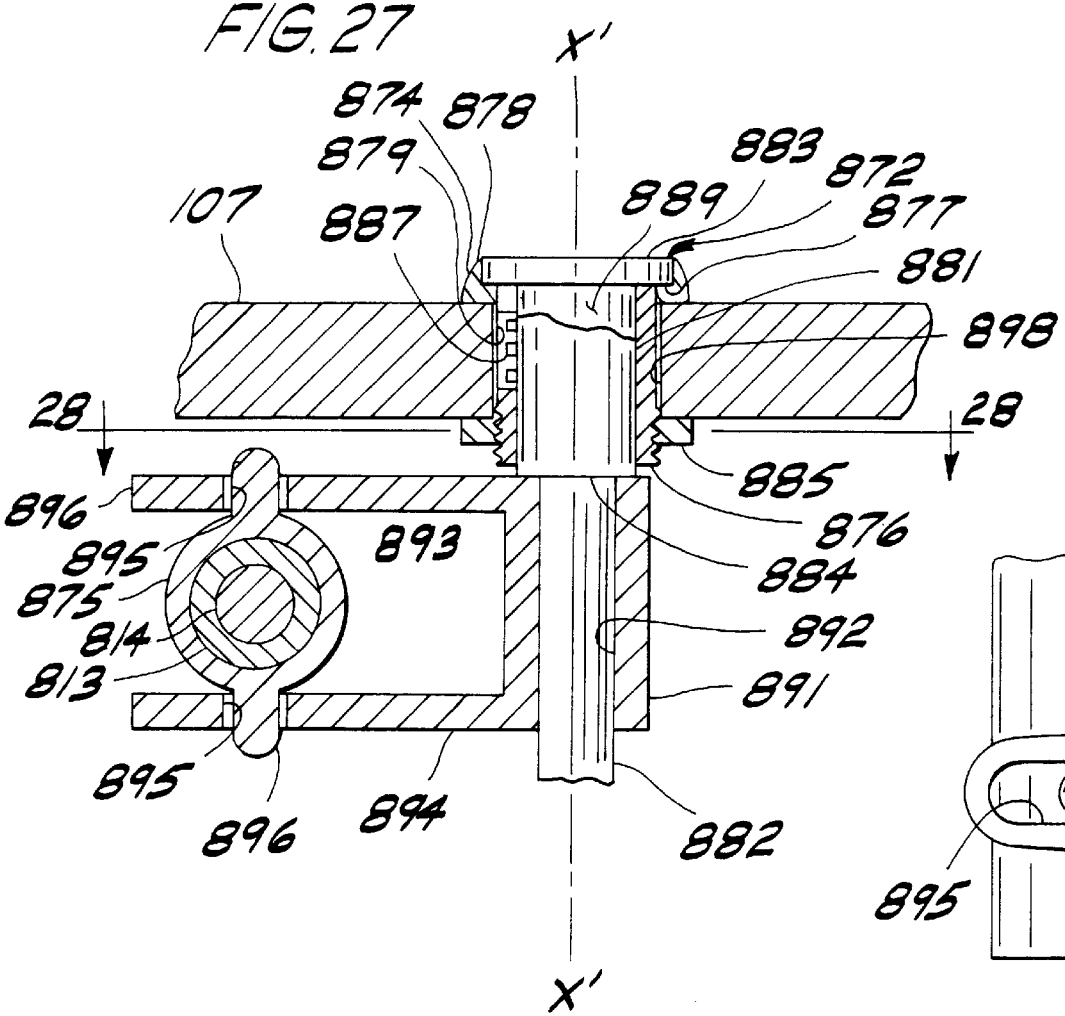
FIG. 27 is a fragmentary horizontal section of the door locking system of FIG. 23.

As shown in FIG. 27, the lock housing 874 is generally cylindrical and is disposed in a second opening 898 of the interior door panel 107 in spaced apart relationship with the door panel opening 117 in which the lock button 813 and shield 875 are disposed. An inner end 878 of the lock housing 874 is flanged radially outward for engaging the interior door panel 107 from within the interior of the automobile. An outer end 876 of the housing 874 is externally threaded for engagement with a lock nut 885 threaded onto the outer end of the lock housing to secure the lock housing in the second opening of the door panel. The key lock 872 is partially received in and extends through the lock housing 874. An internal shoulder 877 formed within the housing 874 adjacent its inner end 878 provides a seat for locating the key lock 872 within the housing. A pair of internal channels (only one of which is shown in FIG. 27 and designated 879, the other of which is substantially identical to that shown in FIG. 18) each extend longitudinally within the housing 874 intermediate its inner and outer ends 878, 876. In the illustrated embodiment, these channels 879 are spaced apart approximately 45°. However, this spacing may vary without departing from the scope of the invention.

The key lock 872 comprises a lock cylinder 881 sized for positioning within the lock housing 874 in closely spaced relationship with the housing, and a torque extension member 882 formed integrally with an outer end 884 of the cylinder along a rotation axis X' of the key lock and projecting longitudinally beyond the outer end 876 of the housing. An inner end 883 of the cylinder is flanged radially outward for seating against the internal annular shoulder 877 of the housing 874. The lock cylinder 881 corresponds closely in construction to a conventional wafer lock as described above with respect to the seventh embodiment. However, pin locks and other suitable locks (not shown) may be used without departing from the scope of this invention.

Wafers 887 (broadly "engaging members") within the lock cylinder 881 are adapted for transverse movement relative to the cylinder between an extended position in which the wafers extend outward from the cylinder and seat in one of the internal channels 879 in the lock housing to rotationally fix the key lock 872 with respect to the lock housing 874, and a withdrawn position in which the wafers are unseated from the channel and drawn into the cylinder so that the key lock is disengaged from the lock housing to allow rotation of the key lock about its rotation axis X' relative to the housing. Springs (not shown) in the lock cylinder 881 bias the wafers 887 toward their extended position. It is contemplated that a set of internal slots (not shown) aligned longitudinally within the housing 874 corresponding respectively to each of the wafers 887 may be used in place of each internal channel 879 so that each wafer is adapted for seating in an individual slot, without departing from the scope of this invention.

The lock cylinder 881 has a key slot 889 (substantially identical to the key lock shown in FIG. 18) therein for receiving a key 790 (FIG. 22) into the cylinder. The key slot 889 is on the inner end 883 of the lock cylinder 881 and is accessible for inserting the key 790 from the interior of the automobile into the lock cylinder. The key 790 is configured for compressing the springs in the lock cylinder 881 upon insertion through the key slot 889 so that the wafers 887 are moved to their withdrawn position in the cylinder. The lock cylinder 881 is free to turn in the housing 874 when the wafers 887 are withdrawn from the channels 879. As shown in FIG. 21, the key 790 is preferably a bi-directional key that can be inserted into the key slot 889 in either of the two possible orientations. The construction and operation of conventional wafer locks is well known in the industry and will not be further described herein.

Figure 29:
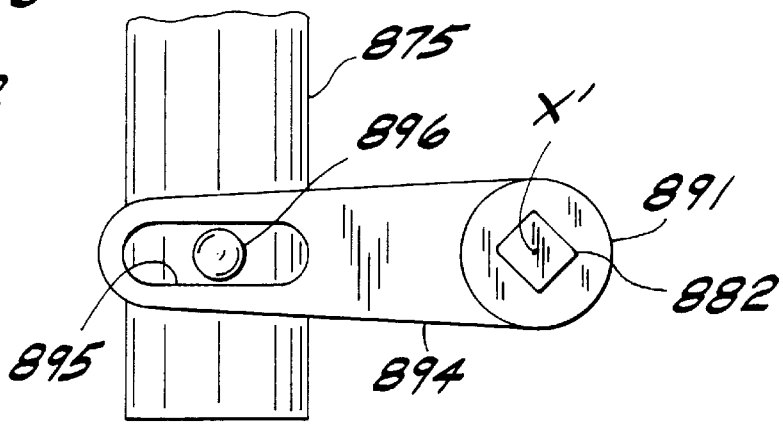
FIG. 29 is fragmentary outer end view of the door locking system of FIG. 23.

As seen best in FIG. 29, the torque extension member 882 is rectangular in cross-section. The torque extension member 882 is received in a lever 891 having an opening 892 in coaxial alignment with the rotation axis X' of the key lock 872. The opening 892 is sized and shaped according to the cross-sectional shape of the torque extension member 882 for receiving the extension member in close-fitting relationship. Thus, turning the key lock 872 about its rotation axis X' conjointly pivots the lever 891.

In the illustrated embodiment, the width of the torque extension member 882 is less than the diameter of the lock cylinder 881, defining a shoulder 893 at the outer end 884 of the lock cylinder. The lever 891 is mounted on the torque extension member 882 and seats against the shoulder 893. The torque extension member 882 extends through the opening 892 of the lever 891 and projects outward of the lever. A suitable fastener (not shown), such as a cotter or dowel pin, extends transversely through the torque extension member 882 adjacent the lever 891 to secure the lever on the torque extension member. The fastener also prevents movement of the key lock 872 out of the inner end 878 of the lock housing 874.

The lever 891 has a pair of lever arms 894 extending transversely with respect to the torque extension member 882 in generally parallel spaced apart relationship with each other. Each of the lever arms 894 has a slot 895 therein located distally from the torque extension member 882. These slots 895 are sized for receiving respective pins 896 extending radially outward from the shield 875 adjacent the lower end of the shield. The spacing between the lever arms 894 is substantially the same as the outer diameter of the shield 875. The lever arms 894 are strong and yet sufficiently flexible and resilient for bending outwardly away from one another for seating the pins 896 within the slots 895 and then returning to their undeflected position in closely spaced relationship with the shield 875 whereby the pins extend through the slots in the lever to 891 connect the lever to the shield. The key lock 872 is thus operatively connected to the shield 875 via the lever 891 so that turning the key lock 872 about its rotation axis X' effects translational movement of the shield between its inoperative and operative positions. The slots 895 in the lever arms 894 are sufficiently long to allow the pins 896 of the shield 875 to slide longitudinally within the slots as the shield is translated relative to the rotating key lock 872 and lever 891.

With reference to FIGS. 23 and 24, when the locking system is in the normal lock mode, the wafers 887 in the lock cylinder 881 of the key lock 872 are in their extended position seated in the first internal channel 879 of the lock housing 874. The engagement of the wafers 887 in the channel 879 secures the shield 875 in its inoperative position within the opening 117 of the interior door panel 107. Thus the lock button 813 is accessible for being grasped by a person's fingers to move the lock button between its locked and unlocked positions for locking and unlocking the locking mechanism 111. Because the green colored shield 875 is recessed within the door panel 107, only the lock button 813 is visible within the interior of the automobile to indicate that the locking system is in the normal lock mode.

To change the locking system from the normal lock mode to the guard lock mode, the key 790 is inserted through the key slot 889 into the lock cylinder 881 of the key lock 872. Insertion of the key 790 compresses the springs inside the lock cylinder 881, thereby unseating the wafers 887 from the first internal channel 879 of the lock housing 874 and retracting the wafers from the channel into the cylinder. The key lock 872 is thus disengaged from the lock housing 874 and may be rotated about its rotation axis X' until it abuts against a stop (not shown). As the key lock 872 is rotated, the torque extension member 882 applies sufficient torque to the lever 891 to pivot the lever arms 894 about the key lock rotation axis X'. The lever arms 894 push upward on the shield 875, thereby moving the shield to its operative position exterior of the door panel opening 117. As the shield 875 is moved to its operative position, the pins 896 of the shield 875 slide longitudinally within the slots 895 in the lever arms 894 to allow the lever 891 to rotate as the shield moves translationally.

When the key lock 872 abuts the stop, the wafers 887 are aligned with the second internal channel in a position corresponding to the guard lock mode. Removing the key 790 from the key lock 872 allows the compressed springs to urge the wafers 887 to their extended position seated in the second internal channel for securing the locking system in its guard lock mode. With the shield 875 secured in its operative position, the lock button 813 extends slightly outward of the shield in its unlocked position so that it is accessible for manual manipulation to its locked position. The person places a finger on top of the button 813 and applies sufficient force to move the lock button down to its locked position. In this position, the lock button 813 is fully recessed within the shield 875 so that the lock button is inaccessible for manual movement back to its unlocked position. Only the green color of the shield 875 is visible within the interior of the automobile to indicate that the locking system is operating in the guard lock mode.

To unlock the locking mechanism when the locking system is in the guard lock mode, the power locking system 119 (FIG. 14) may be used to actuate the lock button 813 to move the lock button to its unlocked position. Alternatively, the key 790 may be used to move the shield 875 to its inoperative position so that the locking system is returned to the normal lock mode as described above.

While the shield 875 illustrated in the above embodiment is cylindric, it is contemplated that the shield may be other than cylindric without departing from the scope of this invention. For example, the shield 875 may be polygonal, or be semi-cylindric and in closely spaced relationship with a portion of the interior door panel 107 in its operative position so that the lock button 813 is shielded in its locked position between the shield and the interior door panel. However, the shield 875 should preferably be shaped to achieve a closely spaced relation with the lock button 813.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A child-safety door locking system mounted on an automobile door, said locking system comprising:

a latch;

a handle operatively connected to the latch for latching and unlatching the door;

a locking mechanism operable to lock and unlock the latch, the handle being incapable of operating to unlatch the door when the locking mechanism locks the latch, the child-safety door locking system being capable of being selectively switched between a normal lock mode in which the door can be manually locked and unlocked, and a guard lock mode in which the door cannot be manually unlocked;

an interior door panel having an inner surface and an outer surface;

a manual lock actuator operatively connected to the locking mechanism of the door and disposed at least partially outside the outer surface of the door panel, the manual lock actuator being manually movable in the normal lock mode relative to the interior door panel from a location outside the outer surface of the door panel between a locked position in which the latch on the door is locked and an unlocked position in which the latch on the door is unlocked;

a shield movable relative to the interior door panel and the manual lock actuator between a retracted inoperative position corresponding to the normal lock mode and an extended operative position corresponding to the guard lock mode, in the inoperative position the shield being withdrawn from the manual lock actuator whereby in the locked position the manual lock actuator may be manually grasped and moved to its unlocked position, and in the operative position the shield occupying a position relative to the door panel and manual lock actuator on the outside surface of the door panel so that the manual lock actuator is shielded in its locked position to block access to the manual lock actuator for manual movement to its unlocked position, the shield and the lock actuator being arranged relative to each other in the operative position for movement of the lock actuator relative to the shield to its unlocked position when the shield is in its operative position corresponding to the guard lock mode of the locking system;

a key lock adapted to receive a key therein to permit movement of the key lock between a first position corresponding to the normal lock mode and a second position corresponding to the guard lock mode; and the key lock being operatively connected to the shield such that turning of the key in the lock moves the shield relative to the manual lock actuator between the normal lock mode and the guard lock mode of the locking system.

2. A child-safety door locking system as set forth in claim 1 wherein the key lock is located for access from the interior of the automobile.

3. A child-safety door locking system as set forth in claim 1 further comprising a lever operatively connecting the key lock to the shield, the lever being connected to the key lock for conjoint movement therewith, the lever being connected to the shield for connecting the key lock with the shield.

4. A child-safety door locking system as set forth in claim 3 wherein the key lock comprises a housing having first and second channels therein, a cylinder received in the housing and connected to the lever, and at least one engaging member movable relative to the cylinder and biased outwardly from the cylinder for reception in the first channel for locking the shield in its inoperative position and for reception in the second channel for locking the shield in its operative position, the engaging member being moved against the bias out of the first or second channel upon insertion of the key into the key lock to permit movement of the cylinder and shield.

5. A child-safety door locking system as set forth in claim 4 wherein said door locking system further comprises an indicator for indicating within the interior of the automobile whether the door locking system is in the normal lock mode or the guard lock mode.

6. A child-safety door locking system as set forth in claim 5 wherein the indicator is constructed for visually displaying within the interior of the automobile whether the door locking system is in the normal lock mode or the guard lock mode.

7. A child-safety door locking system as set forth in claim 6 wherein said indicator includes a first color associated with the manual lock actuator and a second color associated with the shield, the second color being different than said first color, in the guard lock mode the second color being displayed by the shield while the first color is substantially covered by the shield.

8. A child-safety door locking system as set forth in claim 1 wherein said manual lock actuator comprises a lock button extending out from the opening in the interior door panel for accessibility in manually moving the lock button relative to the door panel between its locked and unlocked position.

9. A child safety locking system as set forth in claim 8 wherein the shield is generally tubular and is received around the lock button, the shield being sized to permit relative longitudinal movement of the shield on the lock button between the inoperative and operative positions.

10. A child-safety door locking system as set forth in claim 1 in combination with a key receivable in the key lock for selectively moving the key lock between the first and second positions of the key lock.

11. A child-safety door locking system as set forth in claim 1 further comprising a power lock actuator for automatically actuating the locking mechanism to lock and unlock the latch from a location remote from the door in the automobile, the power lock actuator being incapable of being activated at the door to unlock the locking mechanism.

12. A child-safety door locking system as set forth in claim 1 wherein the key lock is operatively connected to the shield such that turning of the key in the lock effects linear movement of the shield relative to the manual lock actuator between the normal lock mode and the guard lock mode of the locking system.

13. A child-safety door locking system mounted on an automobile door, the locking system comprising:

a latch;

a handle capable of operating the latch to latch and unlatch the door;

a locking mechanism operable to lock and unlock the latch, the handle being incapable of operating to unlatch the door when the locking mechanism locks the latch, the child-safety door locking system being capable of being selectively switched between a normal lock mode in which the door can be manually locked and unlocked, and a guard lock mode in which the door cannot be manually unlocked;

an interior door panel;

a manual lock actuator operatively connected to the locking mechanism of the door movable relative to the interior door panel between a locked position in which the latch on the door is locked and an unlocked position in which the latch on the door is unlocked, the manual lock actuator extending out from an opening in the interior door panel for accessibility in manually moving the manual lock actuator between its locked and unlocked positions;

a shield movable relative to the interior door panel and the manual lock actuator between a retracted inoperative position corresponding to the normal lock mode and an extended operative position corresponding to the guard lock mode, in the inoperative position the shield being recessed within the opening of the door panel whereby in the locked position the manual lock actuator may be manually grasped and moved to its unlocked position, and in the operative position the shield extending outward of the opening in the door panel a distance so that the manual lock actuator is shielded in its locked position to prevent access to the manual lock actuator for manual movement to its unlocked position;

a key lock adapted to receive a key therein to permit movement of the key lock between a first position corresponding to the normal lock mode and a second position corresponding to the guard lock mode, said key lock being operatively connected to the shield for moving the shield between its inoperative and operative positions, and a lever connected to the key lock for conjoint movement therewith, the lever being connected to the shield for operatively connecting the key lock with the shield;

the shield having a pair of pins extending transversely outward from a lower portion of the shield, said lever comprising a pair of lever arms extending from the key lock in spaced apart generally parallel relationship with each other, each of the lever arms having a guide slot sized for receiving a respective one of said pins to operatively connect the key lock to the shield, said pins being slidable within the guide slots as the shield is moved between its inoperative and operative positions.

14. A child-safety door locking system as set forth in claim 13 wherein the key lock has a torque extension member extending therefrom, the lever having a generally central opening sized and shaped for receiving at least a portion of the torque extension member therethrough whereby the lever engages the extension member so that the lever and key lock are connected for conjoint rotation about a longitudinal axis of the key lock.

15. A child-safety door locking system mounted on an automobile door, the locking system comprising:

a latch;

a handle capable of operating the latch to latch and unlatch the door;

a locking mechanism operable to lock and unlock the latch, the handle being incapable of operating to unlatch the door when the locking mechanism locks the latch, the child-safety door locking system being capable of being selectively switched between a normal lock mode in which the door can be manually locked and unlocked, and a guard lock mode in which the door cannot be manually unlocked;

an interior door panel;

a manual lock actuator operatively connected to the locking mechanism of the door movable relative to the interior door panel between a locked position in which the latch on the door is locked and an unlocked position in which the latch on the door is unlocked, the manual lock actuator extending out from an opening in the interior door panel for accessibility in manually moving the manual lock actuator between its locked and unlocked positions;

a shield movable relative to the interior door panel and the manual lock actuator, the shield being moveable relative to the interior door panel between a retracted inoperative position corresponding to the normal lock mode and an extended operative position corresponding to the guard lock mode, in the inoperative position the shield being recessed within the opening of the door panel whereby in the locked position the manual lock actuator may be manually grasped and moved to its unlocked position, and in the operative position the shield extending outward of the opening in the door panel a distance so that the manual lock actuator is shielded in its locked position to prevent access to the manual lock actuator for manual movement to its unlocked position;

a key lock adapted to receive a key therein to permit movement of the key lock between a first position corresponding to the normal lock mode and a second position corresponding to the guard lock mode, said key lock being operatively connected to the shield for moving the shield between its inoperative and operative positions, and a lever connected to the key lock for conjoint movement therewith, the lever being connected to the shield for operatively connecting the key lock with the shield;

the shield having a pin extending outward from a lower portion of the shield, said lever comprising a lever arm extending from the key lock and operatively connected to the pin extending from the shield to operatively connect the key lock to the shield.

* * * * *